US008279024B2

(12) United States Patent
Naji

(10) Patent No.: US 8,279,024 B2
(45) Date of Patent: Oct. 2, 2012

(54) RESONATOR OPERATING IN PLURAL RESONANT MODES WITH SWITCHING CIRCUITRY FOR CONTROLLING THE COUPLING BETWEEN RESONANT MODES

(75) Inventor: Adham Naji, Bristol (GB)

(73) Assignee: The University of Bristol, Clifton, Bristol (GB)

( * ) Notice: Subject to any disclaimer, the term of this patent is extended or adjusted under 35 U.S.C. 154(b) by 169 days.

(21) Appl. No.: 12/619,321

(22) Filed: Nov. 16, 2009

(65) Prior Publication Data

US 2010/0123531 A1 May 20, 2010

(30) Foreign Application Priority Data

Nov. 18, 2008 (GB) ..... 0821085.8

(51) Int. Cl.
*H01P 1/203* (2006.01)
*H01P 7/08* (2006.01)

(52) U.S. Cl. ..... 333/205; 333/235

(58) Field of Classification Search ..... 333/205, 333/235

See application file for complete search history.

(56) References Cited

U.S. PATENT DOCUMENTS 5,484,764 A * 1/1996 Fiediuszko et al. ..... 505/210
5,721,195 A * 2/1998 Grothe et al. ..... 505/210
7,456,711 B1 * 11/2008 Goldsmith ..... 333/209

FOREIGN PATENT DOCUMENTS

EP 1 826 865 A2 8/2007
FR 2 714 217 6/1995
WO WO 2004/073099 A2 8/2004
WO WO 2006/033874 A2 3/2006

OTHER PUBLICATIONS

Search Report, GB0821085.8, dated Jan. 23, 2009.

* cited by examiner

*Primary Examiner* — Benny Lee
(74) *Attorney, Agent, or Firm* — Alston & Bird LLP

(57) ABSTRACT

A resonator system contains one or more resonator, and has a plurality of degenerate resonant modes. Switching circuitry can be operated for controlling a degree of coupling between the resonant modes, such that resonant properties of the resonator system can be controlled. Where the resonator system includes one resonator, the size of a notch in a conductive patch can be controlled to vary the coupling between the resonant modes within that resonator. Where the resonator system includes multiple resonators, the coupling between the resonant modes in the resonators can be varied. A single device can be tuned as required, in order to provide the desired frequency response properties.

11 Claims, 5 Drawing Sheets

RESONATOR OPERATING IN PLURAL RESONANT MODES WITH SWITCHING CIRCUITRY FOR CONTROLLING THE COUPLING BETWEEN RESONANT MODES

FIELD

This invention relates to the tuning of resonator systems, and to resonator systems whose coupling can be adjusted.

BACKGROUND

Resonators are widely used in situations where electromagnetic signals or fields are being generated or detected. A body made of a conductive material with a dielectric substrate will resonate at a particular frequency, with that resonant frequency corresponding to a particular wavelength that is related to the dimensions of the body and the material properties of the body. Where the body is effectively one-dimensional, this relationship is relatively straightforward. However, where the body is two- or three-dimensional, or where there is coupling between two or more such bodies, the relationship becomes more complex.

In one well-known form of resonator, a generally square, thin (that is, effectively two-dimensional) layer, or patch, of conductive material is provided. An effectively two-dimensional body of this type has two resonant modes, relating to oscillations along the width and the length of the patch respectively. In each case, the resonant frequency of the mode corresponds to a wavelength which is approximately double the respective dimension of the patch.

By removing a part of the conductive material, it is possible to establish a degree of coupling between these two resonant modes. For example, a generally square area of conductive material can be removed from a corner of the patch. The degree of coupling affects the overall frequency response of the patch resonator. If the degree of coupling is at a critical level, the frequency response includes a resonance at a particular frequency. If the degree of coupling is below this critical level, the resonator becomes less efficient. If the degree of coupling is above the critical level, the resonant peak is effectively split into two peaks and spread over a wider range of frequencies, that is, the resonator has a larger bandwidth.

SUMMARY OF THE INVENTION

According to a first aspect of the present invention, there is provided a resonator system, comprising at least one resonator, having a plurality of degenerate resonant modes, and further comprising switching circuitry for controlling a degree of coupling between said resonant modes, such that resonant properties of the resonator system can be controlled.

This has the advantage that a single device can be tuned as required, in order to provide the desired frequency response properties.

BRIEF DESCRIPTION OF THE DRAWINGS

For a better understanding of the present invention, and to show how it may be put into effect, reference will now be made, by way of example, to the accompanying drawings, in which.

DETAILED DESCRIPTION OF THE INVENTION

Figure 1:
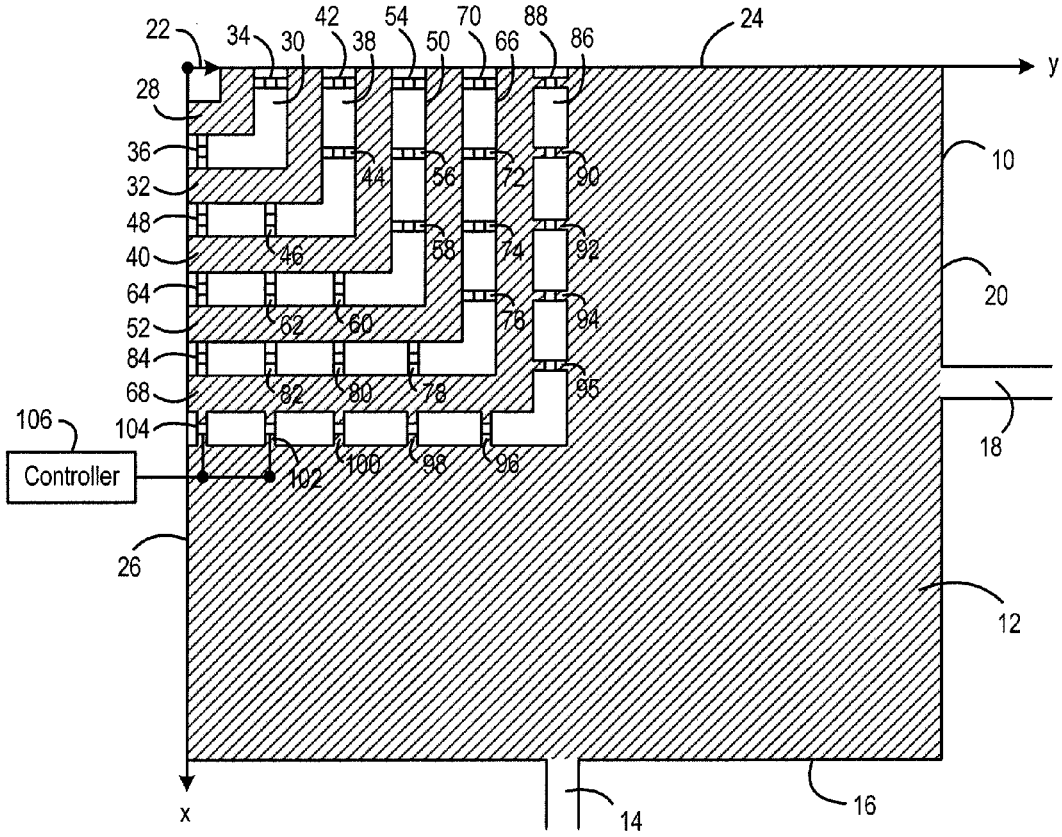
FIG. 1 is a schematic diagram of a first resonator system in accordance with the present invention.

FIG. 1 shows a resonator system with a single symmetric resonator 10. The resonator 10 is formed from a patch of a conductive material 12, such as a metal, sandwiched between two ground planes (not shown in FIG. 1). The patch 12 is generally square, and planar (extending in the x-y plane in the coordinate system shown in FIG. 1). The patch 12 is mounted on a substrate (not shown in FIG. 1), formed of a dielectric material. The patch has two resonant modes, with a first mode extending in the x-direction and a second mode extending in the y-direction. The dimensions of the patch and the dielectric material properties of the substrate determine the frequencies of these resonant modes. More specifically, the length of the patch in each of these directions determines the wavelength $\lambda$, of the respective resonant mode, by the relationship length$\approx\lambda/2$.

By suitable choice of dimensions, resonators in accordance with the present invention, such as the resonator 10, can be used at any desired frequency, but a typical application is in radio frequency, microwave and millimeter communications, where the required frequency of operation means that the dimensions of the patch 12 in the x- and y-directions will be of the order of the wavelength, usually a few millimeters or a few centimeters. The patch 12 is generally thin, in the sense that the dimension in the direction, perpendicular to the x-y plane, will be considerably smaller than the dimensions in the x- and y-directions. It will be appreciated that the same technique can be used, with suitable modification, in the case of a three-dimensional resonator.

A first feed line 14 is connected to supply energy to and/or from the patch 12 at a point which, in this illustrated embodiment, is half way along a first side 16 of the patch, while a second feed line 18 is connected to supply energy to and/or from the patch 12 at a point which, in this illustrated embodiment, is half way along a second side 20 of the patch, the second side 20 being adjacent to the first side 16. Thus, the first feed line 14 is connected to the first resonant mode of the patch, and the second feed line 18 is connected to the second resonant mode of the patch.

In this case, the shape of the patch 12 is modified, in order to achieve a degree of coupling between the first and second resonant modes. Specifically, a notch 22 is formed in the patch 12, at the corner between the third side 24 and the fourth side 26 of the patch 12, where the third side 24 is opposite the first side 16 and the fourth side 26 is opposite the second side 20, although in other embodiments the notch could be of any shape, and could be at any corner of the patch, or could be formed elsewhere in the patch.

The size of the notch 22 has an effect on the resonant properties of the patch 12, because the degree of coupling between the resonant modes affects the overall frequency response of the patch resonator. If there is no notch 22, the first and second resonant modes are effectively uncoupled from each other, and the degree of coupling between them increases as the size of the notch 22 increases. If the degree of coupling is at a critical level, the frequency response includes a resonance at a particular frequency. If the degree of coupling is below this critical level, the resonator becomes less efficient. As the degree of coupling increases above the critical level, the resonant peak splits into two separate peaks, spread over a wider range of frequencies. Provided that these two peaks are not too widely spread, the resonator has a larger operating bandwidth.

FIG. 1 shows an arrangement, whereby the degree of coupling between the resonant modes can be altered, as required, in order to achieve desired resonant properties.

Specifically, a track 28 of conductive material surrounds the notch 22. Then, material is removed from a track 30 surrounding the track 28 of conductive material, while a further track 32 of conductive material surrounds the track 30 where material is removed. Switches 34, 36 are then provided, bridging the track 30 where material has been removed, between the tracks 28, 32 of conductive material.

Similarly, material is removed from a track 38 surrounding the track 32 of conductive material, while a further track 40 of conductive material surrounds the track 38 where material is removed. Switches 42, 44, 46, 48 are then provided, bridging the track 38 where material has been removed, between the tracks 32, 40 of conductive material.

Further, material is removed from a track 50 surrounding the track 40 of conductive material, while a further track 52 of conductive material surrounds the track 50 where material is removed. Switches 54, 56, 58, 60, 62, 64 are then provided, bridging the track 50 where material has been removed, between the tracks 40, 52 of conductive material.

Further, material is removed from a track 66 surrounding the track 52 of conductive material, while a further track 68 of conductive material surrounds the track 66 where material is removed. Switches 70, 72, 74, 76, 78, 80, 82, 84 are then provided, bridging the track 66 where material has been removed, between the tracks 52, 68 of conductive material.

Further, material is removed from a track 86 surrounding the track 68 of conductive material, while the remainder of the patch 12 of conductive material surrounds the track 86 where material is removed. Switches 88, 90, 92, 94, 95, 96, 98, 100, 102, 104 are then provided, bridging the track 86 where material has been removed, between the track 68 of conductive material and the remainder of the patch 12.

In this example, all of the tracks are right angled, but are effectively concentric, centered around the corner of the patch 12 between the third side 24 and the fourth side 26, although other arrangements are equally possible.

Figure 2:
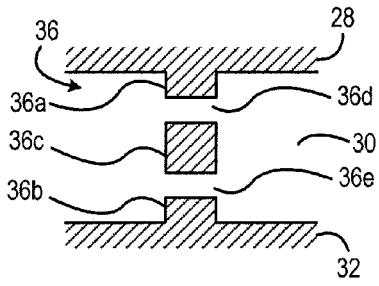
FIGS. 2 and 3 show in more detail switches used in the resonator system of FIG. 1.
Figure 3:
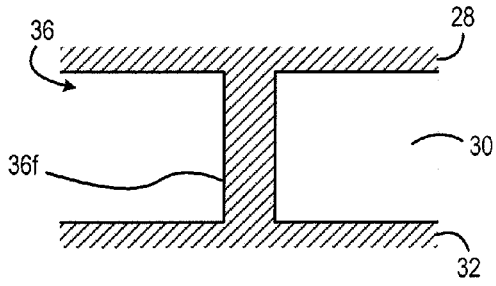

FIG. 2 shows a representative one of the switches 36 in an open position, while FIG. 3 shows the switch 36 in a closed position.

FIG. 2 shows the switch 36 bridging a gap between the conductive tracks 28, 32, across the track 30 where the conductive material has been removed. The switch 36 includes a first end portion 36*a* connected to the first conductive track 28, with a second end portion 36*b* connected to the second conductive track 32. A central conductive element 36*c* is separated from the first end portion 36*a* by a first gap 36*d*, and is separated from the second end portion 36*b* by a second gap 36*e*.

As shown in FIG. 2, the switch 36 is controlled such that the gaps 36*d*, 36*e* remain open, and so there is no continuous conductive path between the conductive tracks 28, 32. The result, assuming that the switch 34 is similarly held open, is that the area covered by the conductive track 28, and by the track 30 where the conductive material has been removed, forms an effective part of the notch 22, and so the degree of coupling between the resonant modes of the system is determined accordingly.

By contrast, FIG. 3 shows the situation where the switch 36 is controlled so that the gaps 36*d*, 36*e* present in FIG. 2 are closed, and there is a continuous conductive path 36*f* between the conductive tracks 28, 32. The result, assuming that the switch 36 is similarly held closed, is that the area covered by the conductive track 28, and by the track 30 where the conductive material has been removed, forms an effective part of the conductive patch 12, and so the degree of coupling between the resonant modes of the system is different from when the switch 36 is open.

The switches bridging the areas where material has been removed may be MEMS switches, and may be of a type suitable for use at radio or microwave frequencies, where the resonator 10 is intended for use at such frequencies. Each of the switches is controlled by a controller 106, although for clarity FIG. 1 only shows the connections from the controller 106 to the switches 102, 104. The controller can have separate connections to each of the switches shown in FIG. 1, allowing each of the switches to be controlled individually, or it can have connections which allow all of the switches bridging one track where material has been removed to be opened and closed together.

Figure 4:
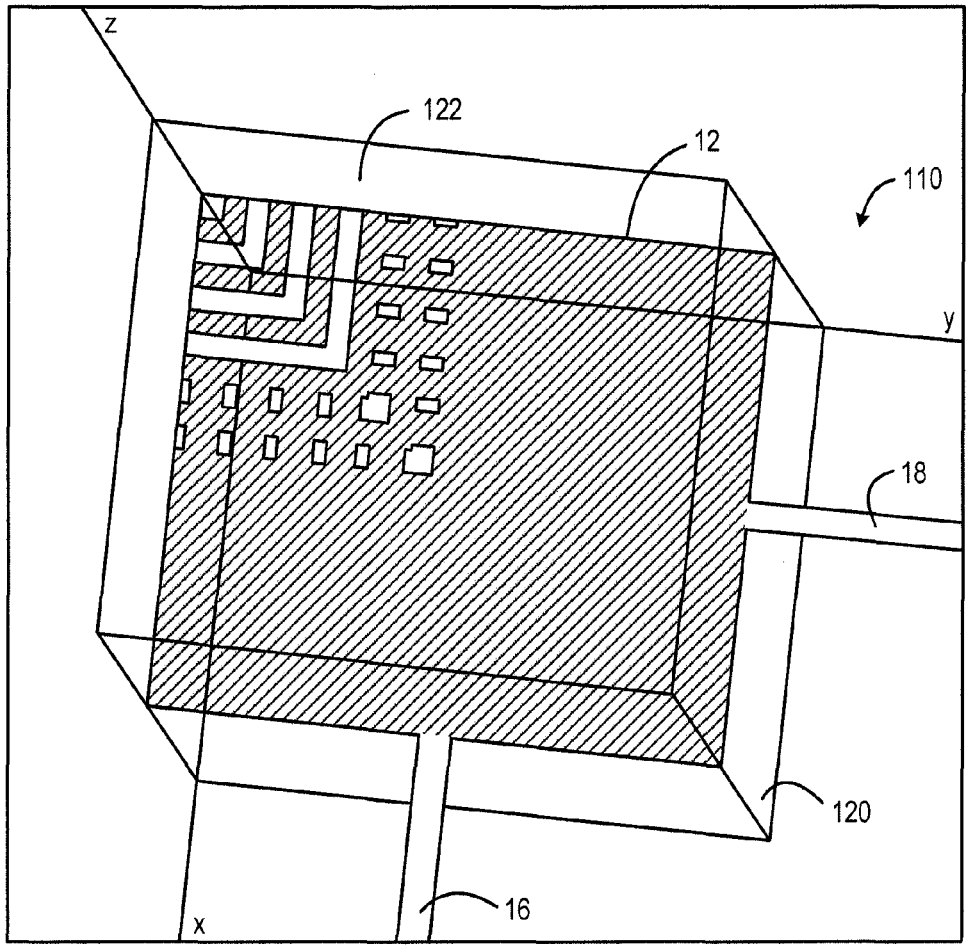
FIG. 4 is a schematic perspective view of a second resonator system in accordance with the present invention, in use.
Figure 5:
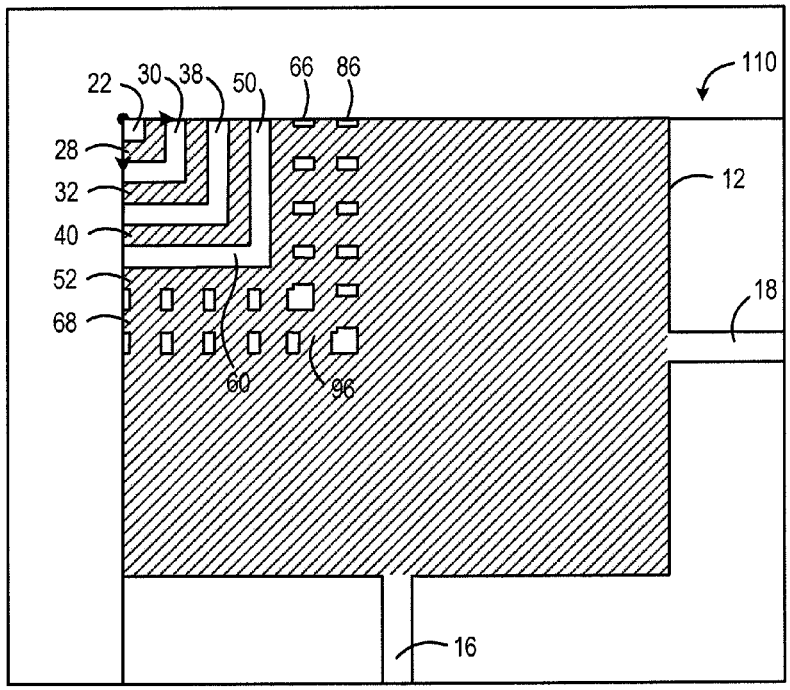
FIG. 5 is a schematic plan view of the resonator system of FIG. 4, in use.

FIG. 4 is a perspective view, showing an alternative resonator 110 in the x, y and z dimensions in more detail, and in use, while FIG. 5 is a plan view, showing the resonator 110 in the same use configuration. The resonator shown in FIGS. 4 and 5 is very similar to that shown in FIG. 1, and so the common features will not be described further in detail. Thus, FIGS. 4 and 5 show the patch 12, and the feed lines 16, 18, mounted between two blocks 120, 122 (FIG. 4) of dielectric material, with at least one ground plane (not shown in FIGS. 4 and 5), in a way that will be well known to the person skilled in the art.

As in the resonator shown in FIG. 5, a track 28 of conductive material surrounds the notch 22. Then, material is removed from a track 30 surrounding the track 28 of conductive material, while a further track 32 of conductive material surrounds the track 30 where material is removed. Similarly, material is removed from a track 38 surrounding the track 32 of conductive material, while a further track 40 of conductive material surrounds the track 38 where material is removed. Further, material is removed from a track 50 surrounding the track 40 of conductive material, while a further track 52 of conductive material surrounds the track 50 where material is removed. Further, material is removed from a track 66 surrounding the track 52 of conductive material, while a further track 68 of conductive material surrounds the track 66 where material is removed. Finally, material is removed from a track 86 surrounding the track 68 of conductive material, while the remainder of the patch 12 of conductive material surrounds the track 86 where material is removed.

As before, switches are provided, bridging each of the tracks 30, 38, 50, 66, 86 where the conductive material has been removed. The switches must be placed sufficiently close to each other that, when two adjacent switches are closed, the area between them from which the conductive material has been removed can effectively form part of the patch 12. For example, the switches can be positioned as shown in FIG. 1.

FIG. 5 shows a representative one of the switches 60 in an open position, with another representative one the switches 96 in a closed position.

Figure 6:
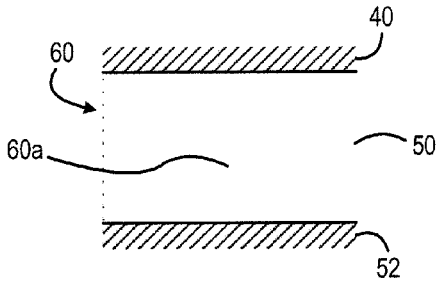
FIGS. 6 and 7 show in more detail switches used in the resonator system of FIGS. 4 and 5.

FIG. 6 shows the switch 60 in more detail. Specifically, FIG. 6 shows the switch 60 bridging a gap between the conductive tracks 40, 52, across the track 50 where the conductive material has been removed. As shown in FIG. 6, the switch 60 is controlled such that there remains a gap 60*a*, and so there is no conductive path between the conductive tracks 40, 52. The result is that the area covered by the conductive track 40, and by the track 50 where the conductive material has been removed, forms an effective part of the notch 22, and so the degree of coupling between the resonant modes of the system is determined accordingly.

Figure 7:
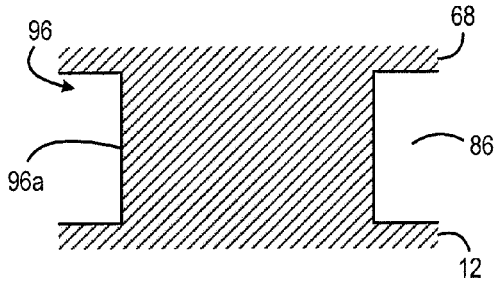

FIG. 7 shows the switch 96 in more detail and, by contrast, FIG. 7 shows the situation where the switch 96 is controlled so that there is a continuous conductive path 96*a* between the conductive track 68 and the remainder of the patch 12. The result is that the area covered by the conductive track 68, and by the track 86 where the conductive material has been removed, forms an effective part of the conductive patch 12, and so the degree of coupling between the resonant modes of the system is different from when the switch is open.

As before, the switches bridging the areas where material has been removed may be MEMS switches, and may be of a type suitable for use at radio or microwave frequencies, where the resonator 10 is intended for use at such frequencies. Again, each of the switches is controlled by a controller. The controller can have separate connections to each of the switches, allowing each of the switches to be controlled independently, or it can have connections which allow all of the switches bridging one track where material has been removed to be opened and closed together.

As mentioned above, FIGS. 4 and 5 show the resonator 110, with the switches controlled so that the resonator has desired properties. Specifically, as shown in FIG. 5, the switches in the track 30 where conductive material has been removed, are open, meaning that there is no conductive path bridging the gap between the tracks 28, 32. Further, the switches in the track 38 where conductive material has been removed, are open, meaning that there is no conductive path bridging the gap between the tracks 32, 40, and the switches (including the switch 60) in the track 50 where conductive material has been removed, are open, meaning that there is no conductive path bridging the gap between the tracks 40, 52.

By contrast, the switches in the track 66 where conductive material has been removed, are closed, meaning that there are conductive paths bridging the gap between the tracks 52, 68, and the switches (including the switch 96) in the track 86 where conductive material has been removed, are closed, meaning that there are conductive paths bridging the gap between the track 68 and the remainder of the patch 12. The presence of these conductive paths means that, provided the dimensions of the tracks and the gaps between them are chosen to be significantly smaller than the wavelengths of the signals in the conductive material, all of the material in the conductive tracks that are connected to the remainder of the patch 12 can be considered to be an active part of the patch. However, the tracks of conductive material that do not have any conductive path to the remainder of the patch 12 can be considered in effect to be part of the notch 22.

Thus, by determining which of the switches should be opened and closed, the effective size of the notch 22 can be varied, and hence the coupling between the resonant modes of the resonator can be varied, with the result that the bandwidth of the resonator system can be controlled.

The resonator systems shown and described above have included a single square patch resonator. However, the invention is equally applicable to patch resonators of other shapes, for example to square patch resonators with cut out portions in their centres, or in their sides.

Figure 8:
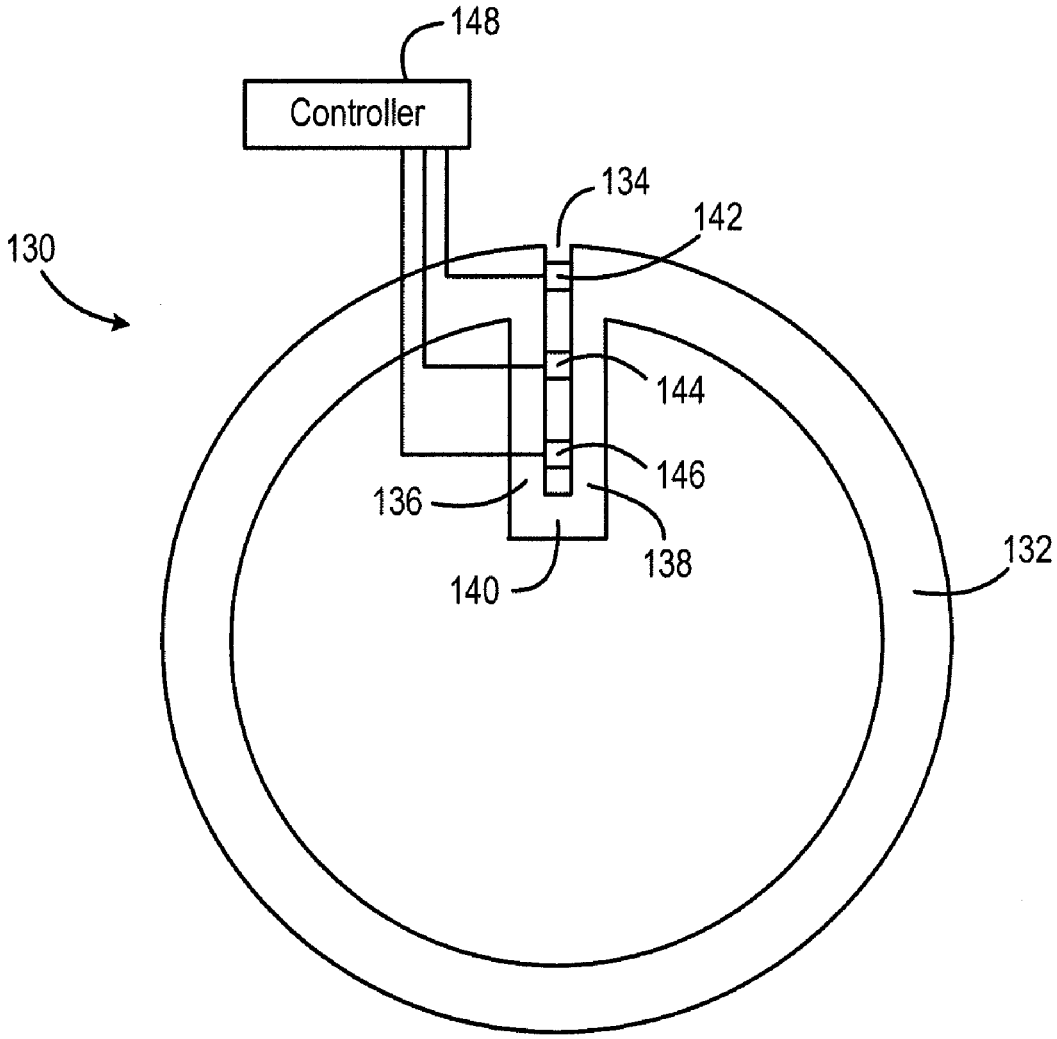
FIG. 8 is a schematic diagram of a third resonator system in accordance with the present invention.

FIG. 8 shows one such alternative embodiment of the invention, where the resonator system includes an annular circular resonator.

In this embodiment of the invention, the resonator system 130 includes a ring 132 of conductive material. The ring 132 extends through almost the full 360° of a circle, but there is a notch 134 at one point. The conductive material then has straight arms 136, 138 extending inwardly from the circumference of the circle at this notch. At their inward ends, the arms 136, 138 are joined by a connecting piece 140. In addition, switches 142, 144, 146 bridge the notch 134 at different points along its length. The switches 142, 144, 146 are controlled by a controller 148.

By selectively opening and closing the switches 142, 144, 146, as described above with reference to the other embodiments of the invention, the degree of coupling between the resonant modes of the system 130 can be varied, and hence the resonant properties of the system 130 can also be varied.

Figure 9:
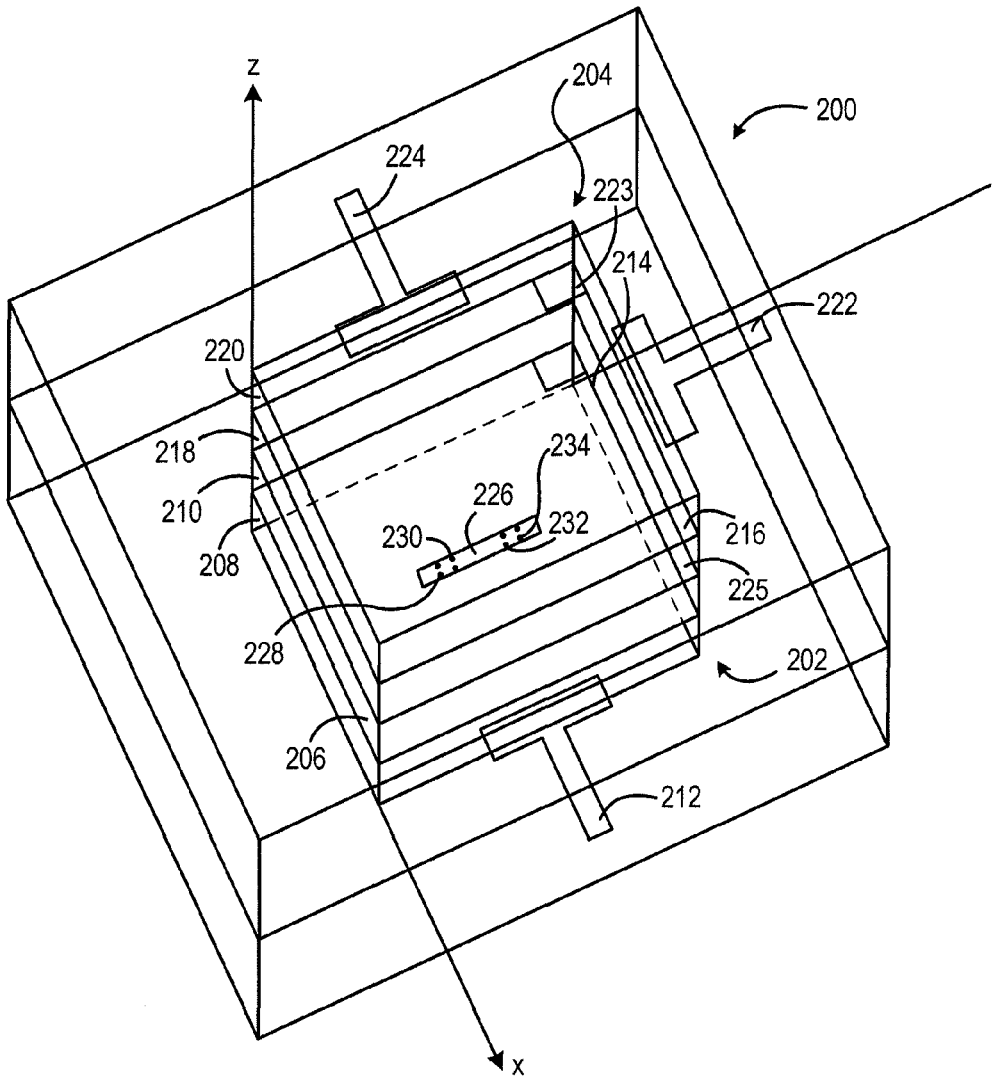
FIG. 9 is a schematic perspective view of a further resonator system in accordance with the present invention.
Figure 10:
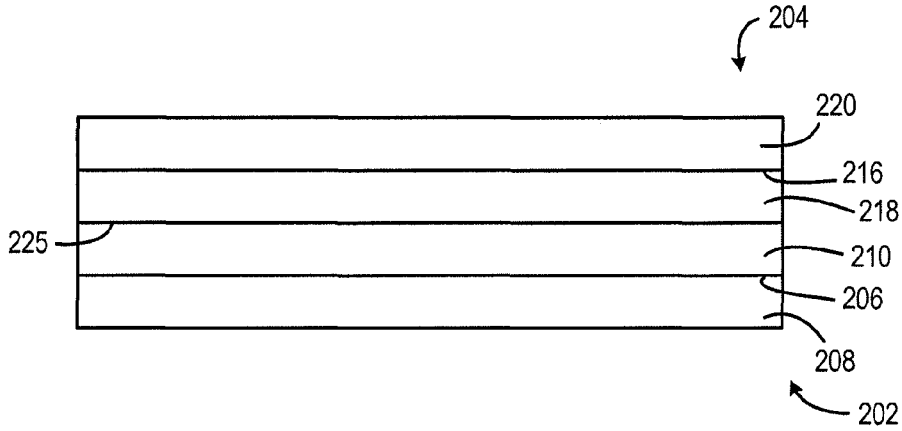
FIG. 10 is a schematic side view of the resonator system of FIG. 9.

FIGS. 9 and 10 show a resonator system in accordance with a further embodiment of the invention. Specifically, FIG. 9 is a perspective view in the x and z dimensions, and FIG. 10 is a side view, showing a resonator system in the form of a filter 200 formed from two stacked dual-mode resonators 202, 204.

The first dual mode resonator 202 is formed from a generally square patch 206 of conductive material, formed between two layers 208, 210 of dielectric material. A feed line 212 (FIG. 9) is in the plane of the patch 206 to connect the resonator 200 to a larger circuit. A generally square notch 214 (FIG. 9) is formed in one corner of the patch 206, in order to introduce a degree of coupling between the resonant modes in the patch 206. Although not shown in FIG. 9 or 10, switches may be provided as described above with reference to FIGS. 2 and 3, or FIGS. 6 and 7, in order to control the effective size of the notch 214, in order to control this degree of coupling, and therefore control the resonant properties of the first resonator 202.

The second dual mode resonator 204 is formed from a generally square patch 216 of conductive material, formed between two layers 218, 220 of dielectric material. Feed lines 222, 224 (FIG. 9) in the plane of the patch 216 connect the resonator 200 to the larger circuit. A generally square notch 223 (FIG. 9) is formed in one corner of the patch 216, in order to introduce a degree of coupling between the resonant modes in the patch 216. Although not shown in FIG. 9 or 10, switches may be provided as described above with reference to FIGS. 2 and 3, or FIGS. 6 and 7, in order to control the effective size of the notch 223, in order to control this degree of coupling, and therefore control the resonant properties of the second resonator 204.

There is thus described a system with three feed lines 212, 222, 224, although the invention is equally applicable to systems with two, four, or any other suitable number of feed lines.

The first and second resonators 202, 204 are coupled together by means of a conductive layer 225 formed between them, and having an aperture or iris 226 formed within it. In this case, the iris 226 (FIG. 9) is of a thin rectangular shape, but it can be any shape.

Switches 228, 230, 232, 234 bridge across the iris 226 at different points along its length as shown in FIG. 9. The switches 228, 230, 232, 234 can be opened and closed under the control of a controller (not shown in FIGS. 5 and 6). By suitable opening and closing of the switches 228, 230, 232, 234, the degree of coupling between the first and second resonators 202, 204 can be controlled, and hence the resonant properties of the resonator 200 can be controlled.

Although the invention is described herein with reference to resonator systems that include two-dimensional patch resonators, it will be appreciated that the invention is equally applicable to three-dimensional resonators.

In addition, although the invention is described with reference to resonator systems containing two stacked resonators, it will be appreciated that the invention is equally applicable to larger stacked resonators, or to other methods of controlling the degree of coupling between the resonant modes in separate resonators.

Resonator systems as described herein can be useful in tunable radio frequency or microwave antennas, matching networks, phase shifters, duplexers, and other radio frequency or microwave circuitry, where coupling tuning is required.

The invention claimed is:

1. A resonator system, comprising at least one resonator, having a plurality of degenerate resonant modes, wherein the at least one resonator comprises a generally symmetric patch resonator having a notch formed therein, wherein said notch comprises a series of concentric tracks from which conductive material has been removed, and further comprising switching circuitry for controlling a degree of coupling between said plurality of resonant modes, such that resonant properties of the resonator system can be controlled, wherein said switching circuitry controls an effective size of the notch by allowing said concentric tracks to be selectively bridged in order to achieve the degree of coupling between degenerate resonant modes of said patch resonator.

2. A resonator system as claimed in claim 1, wherein said notch is formed in a corner of said patch resonator.

3. A resonator system as claimed in claim 1, wherein the generally symmetric patch resonator comprises a square conductive patch.

4. A method of controlling a resonator system, the system comprising at least one resonator, having a plurality of degenerate resonant modes, and the method comprising controlling a degree of coupling between said plurality of resonant modes, by operating switching circuitry, such that resonant properties of the resonator system can be controlled, wherein the switching circuitry comprises MEMS switches.

5. A method of controlling a resonator system, the system comprising at least one resonator, having a plurality of degenerate resonant modes, wherein the at least one resonator comprises a plurality of resonators, and wherein said plurality of resonators comprise a plurality of conductive patches, having a respective conductive layer formed therebetween, with a respective iris in said corresponding conductive layer, and said method comprising controlling a degree of coupling between said plurality of resonant modes, by operating respective switching circuitry to control a size of said corresponding iris in order to control the degree of coupling between resonant modes, such that resonant properties of the resonator system can be controlled.

6. A method as claimed in claim 5, wherein said respective iris is a region from which corresponding conductive material has been removed, and the method comprises operating said respective switching circuitry to allow said corresponding iris to be selectively bridged.

7. A resonator system, comprising at least one resonator, having a plurality of resonant modes, wherein said at least one resonator comprises a plurality of resonators, wherein the plurality of resonators comprise a plurality of respective conductive patches, having a conductive layer formed therebetween, with a respective iris in said corresponding conductive layer, and wherein the resonator system further comprises respective switching circuitry for controlling a degree of coupling between said plurality of resonant modes of said plurality of resonators, such that resonant properties of the resonator system can be controlled, wherein said respective switching circuitry controls a size of said corresponding iris in order to control the degree of coupling between resonant modes.

8. A resonator system as claimed in claim 7, wherein said respective iris is a region from which corresponding conductive material has been removed, and said respective switching circuitry allows said corresponding iris to be selectively bridged.

9. A resonator system as claimed in claim 8, wherein said respective iris is a rectangular region from which corresponding conductive material has been removed.

10. A resonator system, comprising at least one resonator, having a plurality of degenerate resonant modes, and further comprising switching circuitry for controlling a degree of coupling between said plurality of resonant modes, such that resonant properties of the resonator system can be controlled, wherein the switching circuitry comprises MEMS switches.

11. A method of controlling a resonator system, the system comprising at least one resonator, having a plurality of degenerate resonant modes, wherein the at least one resonator comprises a generally symmetric patch resonator having a notch formed therein, wherein said notch comprises a series of concentric tracks from which conductive material has been removed, and the method comprising controlling a degree of coupling between said plurality of resonant modes, by operating switching circuitry to control an effective size of the notch by selectively bridging said concentric tracks in order to achieve the degree of coupling between degenerate resonant modes of said patch resonator, such that resonant properties of the resonator system can be controlled.

* * * * *

UNITED STATES PATENT AND TRADEMARK OFFICE

CERTIFICATE OF CORRECTION

PATENT NO. : 8,279,024 B2
APPLICATION NO. : 12/619321
DATED : October 2, 2012
INVENTOR(S) : Naji It is certified that error appears in the above-identified patent and that said Letters Patent is hereby corrected as shown below:

Column 8,
Line 13, "a conductive layer" should read --a respective conductive layer--.

Signed and Sealed this
Ninth Day of April, 2013

Teresa Stanek Rea
*Acting Director of the United States Patent and Trademark Office*